US006191646B1

(12) United States Patent
Shin

(10) Patent No.: US 6,191,646 B1
(45) Date of Patent: Feb. 20, 2001

(54) TEMPERATURE COMPENSATED HIGH PRECISION CURRENT SOURCE

(75) Inventor: Yun Tae Shin, Ichon-shi (KR)

(73) Assignee: Hyundai Electronics Industries Co., Ltd., Ichon-shi (KR)

( * ) Notice: Under 35 U.S.C. 154(b), the term of this patent shall be extended for 0 days.

(21) Appl. No.: 09/342,092

(22) Filed: Jun. 29, 1999

(30) Foreign Application Priority Data

Jun. 30, 1998 (KR) ..... 98-25240

(51) Int. Cl.[7] ..... G05F 3/02
(52) U.S. Cl. ..... 327/543; 327/539; 323/315
(58) Field of Search ..... 327/538, 539, 327/543; 323/312, 315

(56) References Cited

U.S. PATENT DOCUMENTS

| | | | | |
|---|---|---|---|---|
| 4,215,282 | | 7/1980 | Brown et al. . | |
| 4,525,663 | | 6/1985 | Henry . | |
| 4,591,743 | | 5/1986 | Kung . | |
| 4,604,532 | | 8/1986 | Gilbert . | |
| 4,966,034 | | 10/1990 | Bock et al. . | |
| 5,034,626 | * | 7/1991 | Pires et al. | 327/543 |
| 5,159,357 | | 10/1992 | Ng et al. . | |
| 5,373,226 | | 12/1994 | Kimura . | |
| 5,430,395 | * | 7/1995 | Ichimaru | 327/538 |
| 5,481,180 | | 1/1996 | Ryat . | |
| 5,604,427 | * | 2/1997 | Kimura | 323/313 |
| 5,631,600 | * | 5/1997 | Akioka et al. | 327/543 |
| 5,818,294 | * | 10/1998 | Ashmore, Jr. | 327/543 |
| 5,910,749 | * | 6/1999 | Kimura | 327/541 |

FOREIGN PATENT DOCUMENTS 8-194040 7/1996 (JP) .

* cited by examiner

*Primary Examiner*—Terry D. Cunningham
(74) *Attorney, Agent, or Firm*—Jacobson, Price, Holman & Stern, PLLC

(57) ABSTRACT

A temperature-compensated high precision current source provides a constant current regardless of temperature change, thereby ensuring the stability of electric circuits. The temperature-compensated high precision current source comprises a control means connected to a voltage supply for producing control signal, a first current generating means for generating a first current which is proportional to absolute temperature in response to the signals from the control means, a first current transferring means for transferring the first current to a common node, a second current generating means for generating a second current which is inversely proportional to absolute temperature in response to the signals from the control means, a first current transferring means for transferring the second current to a common node, the common node for adding the first and second currents and generating a third current which is compensated for a current variation caused by the temperature variation at the first and second current generating means and an output means connected to the common node for receiving the third current from the common node and generating a constant current.

6 Claims, 4 Drawing Sheets

TEMPERATURE COMPENSATED HIGH PRECISION CURRENT SOURCE

FIELD OF THE INVENTION

The present invention relates to a current source circuit and, more particularly, to a high-precision current source capable of supplying a constant current regardless of temperature change.

Description of the Prior Art

Generally, high-precision current sources have been widely used for high-precision analog-to-digital or digital-to-analog converters. The current sources provide a constant current regardless of temperature change, thus they are used to bias operational amplifiers or to design the reference voltage circuits.

Referring to FIG. 1 showing a typical current source according to the prior art, a bias current I is supplied using the base-emitter voltage $V_{BE1}$ of the bipolar junction transistor Q1. That is, the bias current I is obtained as $V_{BE1}/R$.

Here, the resistance R and the base-emitter voltage $V_{BE1}$ have positive and negative temperature coefficients, respectively. Therefore, a disadvantage of the current source is that the bias current $I(=V_{BE1}/R)$ is a current in strongly negative direction (hereinafter, referred to as IPTAT (inversely proportional to absolute temperature) current).

Referring to FIG. 2 showing a current source using a thermal voltage $V_T$, the current source supplies a bias current I as $V_T\ln(NI_{E1}/I_{B2})/R$, where N is a ratio of the emitter area of the bipolar junction transistor Q2 to the emitter area of the bipolar junction transistor Q1, $I_{E1}$ and $I_{E2}$ are the emitter currents of the bipolar junction transistors Q1 and Q2, respectively. Here, the positive temperature coefficient in the thermal voltage $V_T$ is much larger than that in the resistance R. Therefore, a disadvantage of the current source is that the bias current I $(=V_T\ln(NI_{E1}/I_{E2})/R)$ is a current in a positive direction (hereinafter, referred to as PTAT (proportional to absolute temperature) current).

Therefore, the currents provided by the above-mentioned current sources may change with changes of temperature.

SUMMARY OF THE INVENTION

It is, therefore, an object of the present invention to provide a temperature-compensated high precision current source that can provide a constant current regardless of temperature change, thereby ensuring the stability of electric circuits. In accordance with an aspect of the present invention, there is provided a temperature-compensated high precision current source, comprising: a) a control means connected to a voltage supply for producing control signal; b) a first current generating means for generating a first current which is proportional to absolute temperature in response to the signals from the control means; c) a first current transferring means for transferring the first current to a common node; d) a second current generating means for generating a second current which is inversely proportional to absolute temperature in response to the signals from the control means; f) a first current transferring means for transferring the second current to a common node; g) the common node for adding the first and second currents and generating a third current which is compensated for a current variation caused by the temperature variation at the first and second current generating means; and h) an output means connected to the common node for receiving the third current from the common node and generating a constant current.

BRIEF DESCRIPTION OF THE DRAWINGS

The above and other objects and features of the present invention will become apparent from the following description of the preferred embodiments given in connection with the accompanying drawings, in which.

DETAILED DESCRIPTION OF THE PREFERRED EMBODIMENTS

Hereinafter, the present invention will be described in detail referring to the accompanying drawings.

Figure 1:
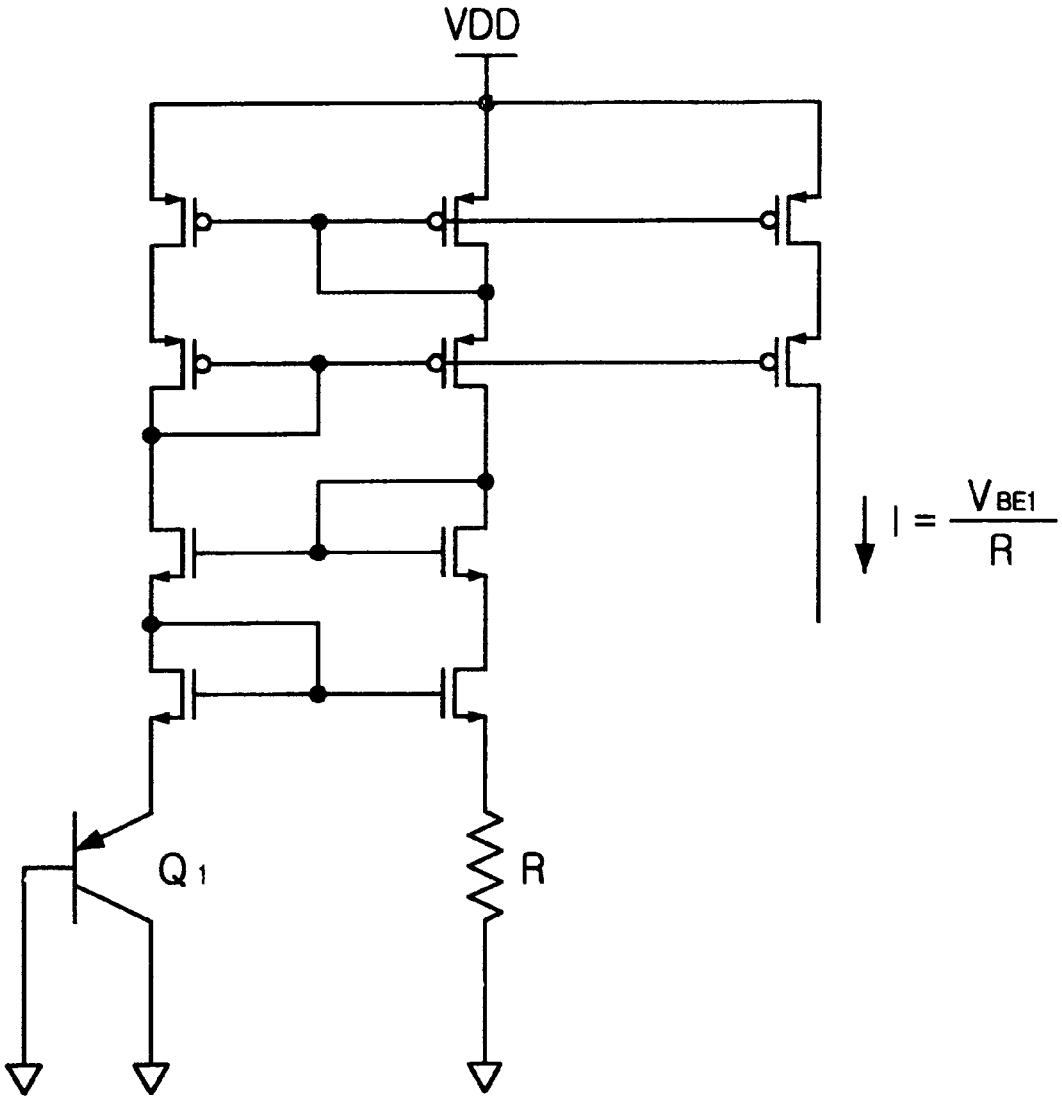
FIG. 1 (PRIOR ART)
FIG. 1 shows a schematic diagram of a current source according to the prior art.
Figure 2:
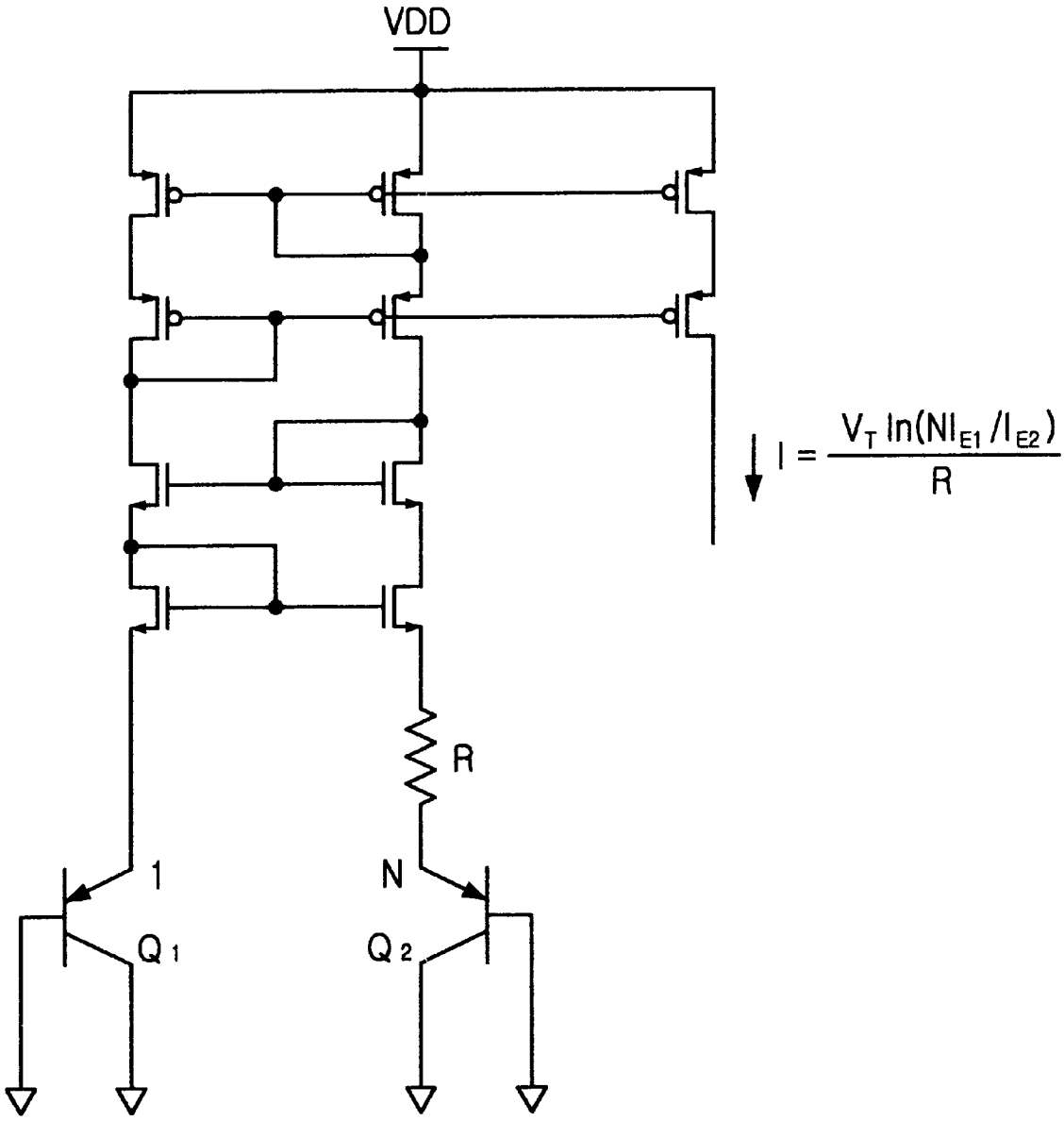
FIG. 2 (PRIOR ART)
FIG. 2 shows a schematic diagram of a current source using the thermal voltage according to the prior art.
Figure 3:
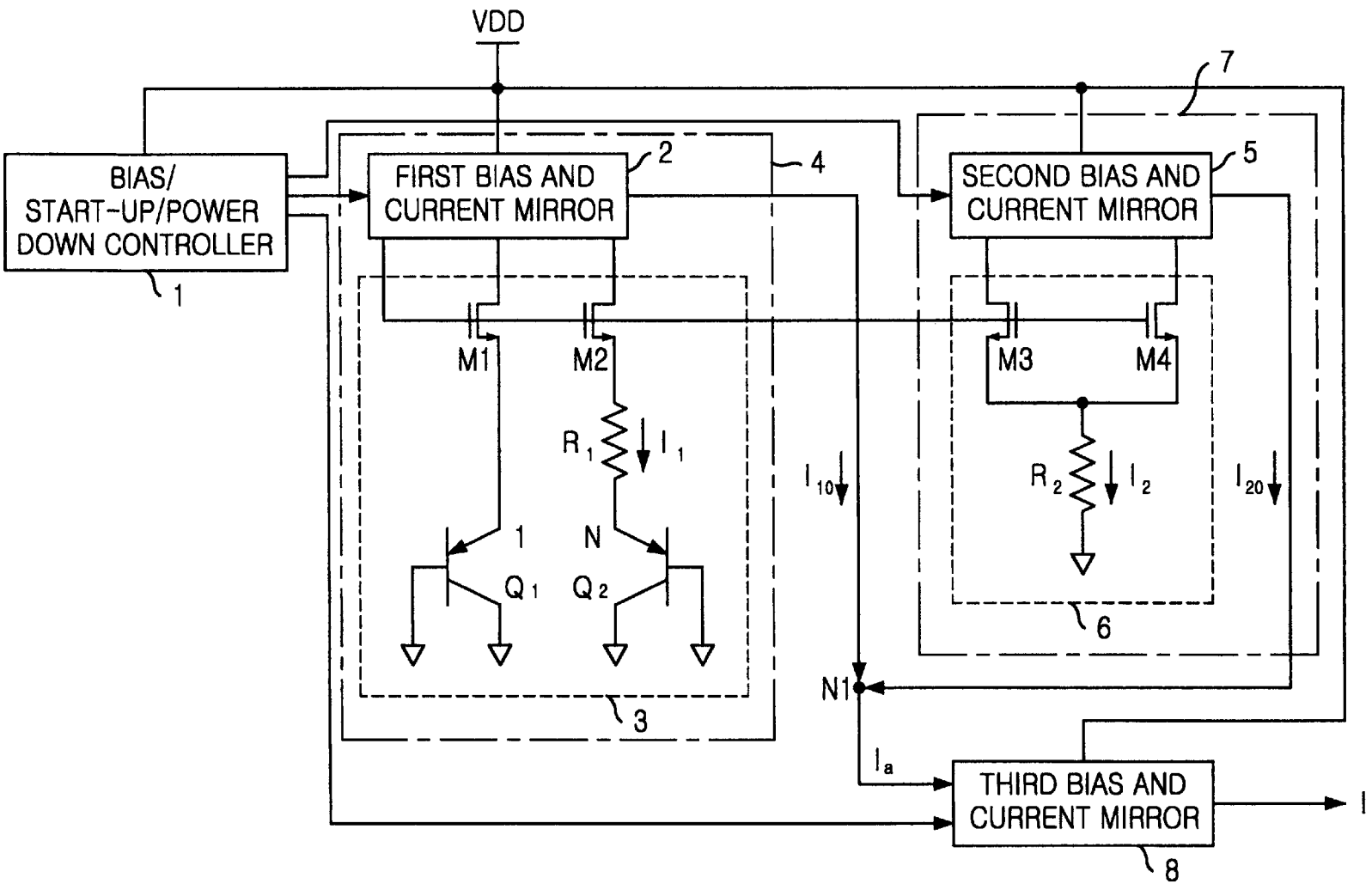
FIG. 3 shows a block diagram of a current source in accordance with the present invention.

Referring to FIG. 3, a current source according to the present invention includes a bias/start-up/power-down controller 1, a first current generating part 4 having a first bias and current mirror 2 and a PTAT current generator 3, a second current generating part 7 having a second bias and current mirror 5 and an IPTAT current generator 6, an output common node N1 at which the output currents $I_{10}$ and $I_{20}$ from the first and second current generating parts 4 and 7 are added, and a third bias and current generating part 8 for receiving a resulting current $I_2$ from the output common node N1 and outputting a temperature-compensated current I.

The bias/start-up/power-down controller 1 acts as a biasing or starting up the current generating parts 4, 7 and 8 and acts as a powering down each of the output currents $I_{10}$, $I_{20}$ and I.

When the bias/start-up/power-down controller 1 outputs a normal operation signal in a normal operation, the bias/start-up/power-down controller 1 either biases or starts up the first bias and current mirror 2, the second bias and current mirror 5 and the third bias and current mirror 8. When the bias/start-up/power-down controller 1 outputs a power-down signal in a power-down mode, the bias/start-up/power-down controller 1 powers down the first, second current generating parts 4 and 7 and the third bias and current mirror 8, which respectively generate the output currents $I_{10}$, $I_{20}$ and I.

Here, the output current $I_{10}$ from the first current generating part 4, which is equal to the current $I_1$ flowing across a resistance $R_1$, is generated by a current mirror operation of the first bias and current mirror 2. Similarly, the output current $I_{20}$ from the second current generating part 7, which is approximately equal to the current $I_2$ flowing across a NMOS transistor M4, is generated by a current mirror operation of the second bias and current mirror 5.

That is, in case of the normal operation, the first current generating part 4 generates a first current $I_{10}$ equal to a PTAT current $I_1$ from NMOS transistors M1 and M2 and PNP bipolar junction transistors $Q_1$ and $Q_2$ of the PTAT current generator 3. The PTAT current $I_1$ is obtained as follows:

$$-V_{BE1}-V_{GS1}+V_{GS2}+I_1R_1+V_{BE2}=0$$

if the size of the M1 and M2 is equal, then $V_{GS1}=V_{GS2}$ therefore, $I_1=(V_{BE1}-V_{BE2})/R_1=V_T\ln(NI_{E1}/I_{E2})/R_1$ where, $V_{GS1}$ and $V_{GB2}$ are the gate-source voltages of the NMOS transistors M1 and M2, respectively, $V_{BE1}$ and $V_{BE2}$ are the base-emitter voltages of the PNP bipolar junction transistors $Q_1$ and $Q_2$, respectively, $I_{E1}$ and $I_{E2}$ are the emitter currents of the PNP bipolar junction transistors $Q_1$ and $Q_2$, respectively, $V_T$ is the thermal voltage and N is a ratio of the emitter area of the PNP bipolar junction transistor $Q_2$ to the emitter area of the PNP bipolar junction transistor $Q_1$. As described above, the PTAT current $I_1$ is outputted as the output current $I_{10}$ of the first current generating part 4 by the current mirror operation.

In the second current generating part 7, if the channel widths and lengths of NMOS transistors M1, M3, and M4 are equal each other, the current $I_2$ flowing across the resistance $R_2$ is obtained as $V_{BE1}/R_2$, and a current flowing across the NMOS transistor M4 is obtained as $V_{BE1}/2R_2$. Accordingly, the second current generating part 7 generates a second current $I_{20}$ ($=V_{BE1}/2R_2$) equal to the current flowing across the resistance $R_2$ by the current mirror operation.

At this time, the output currents $I_{10}$ and $I_{20}$ of the first and second current generating parts 4 and 7 are added at the output common node N1 and the added current $I_s$ is outputted to the third bias and current mirror 8. The added current $I_a$ from the output common node N1 is obtained as follows:

$$I_a=V_T ln(NI_{E1}/I_{E2})/R_1+V_{BE1}/2R_2$$

Since the added current $I_2$ is constant regardless of temperature change, the third bias and current mirror 8 and outputs a constant current I equal to the added current $I_2$ regardless of the temperature change by a current mirror operation.

Figure 4:
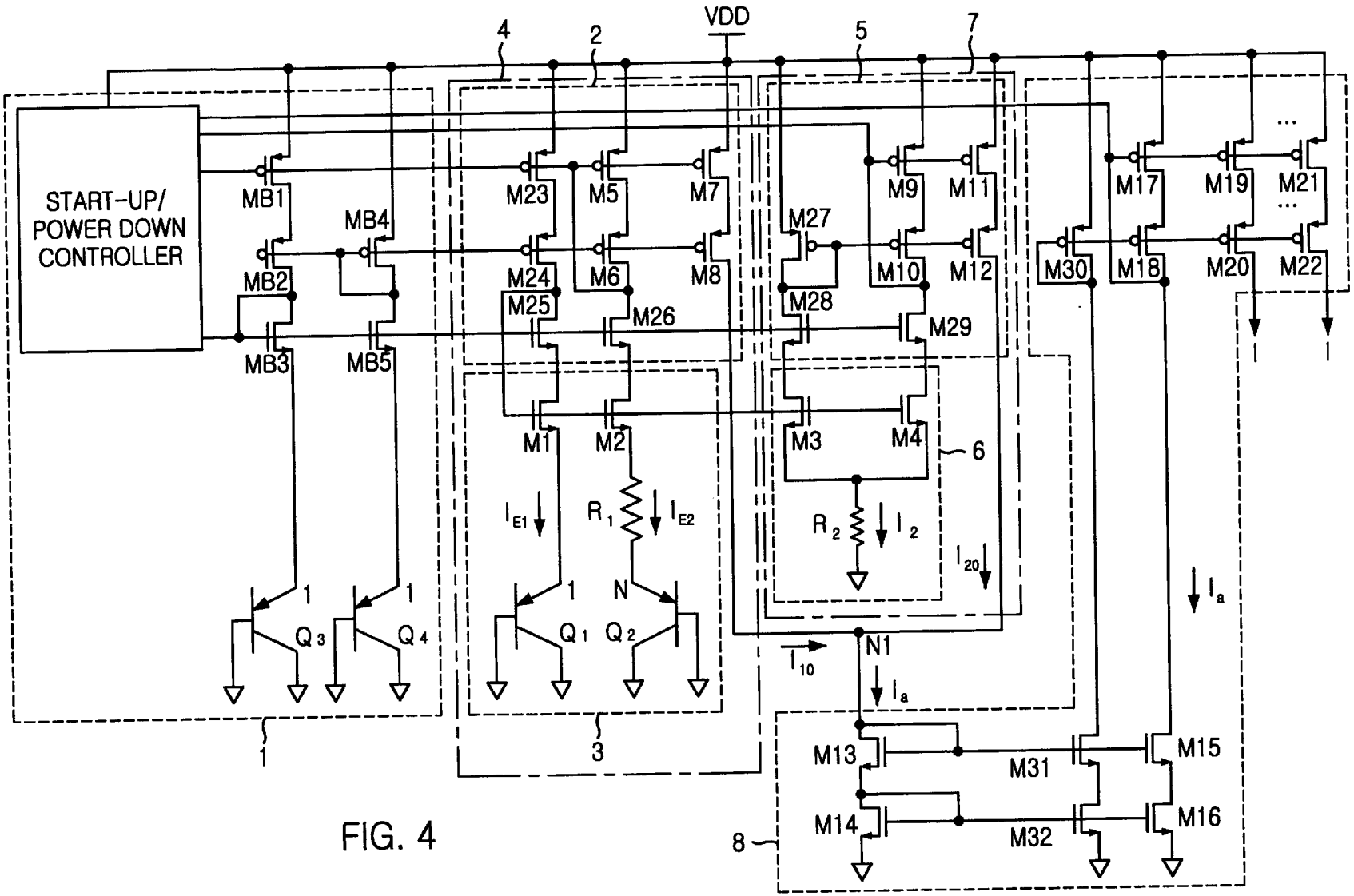
FIG. 4 shows a detailed circuit diagram of FIG. 3.

Referring to FIG. 4 illustrating a detailed circuit diagram of FIG. 3, when the normal operation signal is outputted from the bias/start-up/power-down controller 1, and the gate-source voltages $V_{GS1}$ and $V_{BS2}$ of the NMOS transistors M1 and M2 in the PTAT current generator 3 are equal each other, the first current $I_{10}$ is supplied as $V_T\ln(NI_{E1}/I_{E2})/R_1$ by the current mirror operation through NMOS transistor M7 and M8.

If the width and length of NMOS transistor M1 of the PTAT current generator 3 and NMOS transistors M3 and M4 of the IPTAT current generator 5 are equal each other, the current $I_3$ flowing across the resistance $R_2$ is $V_{BE1}/R_2$ and the current flowing through the NMOS transistor M4 is $V_{BE1}/2R_2$. Accordingly, the second current $I_{20}$ is supplied as $V_{BE1}/2R_2$ by the current mirror operation through NMOS transistor M11 and M12.

Next, when the first and second currents $I_{10}$ and $I_{20}$ are added at the output common node N1, the added output current $I_a$ is as follows: $V_T\ln(NI_{E1}/I_{E2})R_1+V_{BE1}/2R_2$ and is constant regardless of the temperature change. Therefore, the output current I of the third bias and current mirror 8 is also constant. Furthermore, the third bias and current mirror 8 is capable of supplying a plurality of output currents I by the current mirror operation through the PMOS transistors M19, M20, M21, and M22.

Advantages of the present invention are that by generating the current without using operational amplifiers, the change of current value caused by an offset voltage can be reduced and a temperature-compensated constant current is generated.

While the present invention has been described with respect to certain preferred embodiments only, other modifications has variation may be made without departing from the spirit and scope of the present invention as set fourth in the following claims.

What is claimed is:

1. A high precision current source, comprising:

a) a control means connected to a voltage supply for producing a control signal;

b) a first current generating part having a first current generating means for generating a first current which is proportional to absolute temperature in response to the control signal from the control means and a first current transferring means for transferring the first current to a common node, wherein the first current generating means including:

first and second NMOS transistors, each of which has a drain connected to the first current transferring means and a gate commonly connected to the first current transferring means;

a first bipolar junction transistor which has an emitter serially connected to a source of the first NMOS transistor, and a base and a collector connected to a ground voltage level, respectively;

a first resistor serially connected to a source of the second NMOS transistor; and a second bipolar junction transistor which has an emitter serially connected to the first resistor, and a base and a collector connected to the ground voltage level, respectively;

c) a second current generating means for generating a second current which is inversely proportional to absolute temperature in response to the control signal from the control means;

d) a second current transferring means for transferring the second current to the common node, wherein the common node adds the first and second currents and generates a third current which is compensated for a current variation caused by a temperature variation at the first and second current generating means; and e) an output means connected to the common node for receiving the third current from the common node and generating a constant current.

2. The high precision current source as recited in claim 1, wherein the second current generating means comprises:

third and fourth NMOS transistors, whose drains are connected to the second current transferring means, whose gates are commonly connected to the gates of the first and second NMOS transistors, and whose sources are commonly connected to each other; and a second resistor serially connected between the common source of the third and fourth NMOS transistors and the ground voltage level.

3. The high precision current source as recited in claim 1, wherein the first current generating means generates the first current obtained by dividing a difference between the base-emitter voltages of the first bipolar junction transistor and the second bipolar junction transistor by a resistance of the first resistor.

4. The high precision current source as recited in claim 2, wherein the second current generating means generates the second current obtained by dividing the base-emitter voltage of the first bipolar junction transistor by a resistance of the second resistor.

5. The high precision current source as recited in claim 1, wherein the second bipolar junction transistor has an emitter area N times as wide as the first bipolar junction transistor has.

6. The high precision current source as recited in claim 1, wherein the output means further outputs at least one fourth current.

* * * * *